US009136596B2

(12) United States Patent
Lenormand et al.

(10) Patent No.: US 9,136,596 B2
(45) Date of Patent: Sep. 15, 2015

(54) MOBILE DIRECTIONAL ANTENNA WITH POLARIZATION SWITCHING

(71) Applicant: THALES, Neuilly-sur-Seine (FR)

(72) Inventors: Regis Lenormand, Blagnac (FR); Jean-Francois David, Merignac (FR); Jean-Luc Almeida, Le Fauga (FR); Alejandro Valero-Nogueria, Valencia (ES); Jose Ignacio Herranz-Herruzo, Valencia (ES)

(73) Assignee: THALES, Neuilly sur Seine (FR)

( * ) Notice: Subject to any disclaimer, the term of this patent is extended or adjusted under 35 U.S.C. 154(b) by 305 days.

(21) Appl. No.: 13/680,088

(22) Filed: Nov. 18, 2012

(65) Prior Publication Data

US 2013/0176172 A1 Jul. 11, 2013

(30) Foreign Application Priority Data

Nov. 21, 2011 (FR) ..... 11 03536

(51) Int. Cl.

| | |
|---|---|
| ***H01Q 3/24*** | (2006.01) |
| ***H01Q 13/22*** | (2006.01) |
| ***H01Q 15/24*** | (2006.01) |
| ***H01Q 21/00*** | (2006.01) |

(52) U.S. Cl.

CPC ..... *H01Q 3/24* (2013.01); *H01Q 13/22* (2013.01); *H01Q 15/244* (2013.01); *H01Q 21/005* (2013.01)

(58) Field of Classification Search

CPC ..... H01Q 3/24
USPC ..... 343/771; 342/361
See application file for complete search history.

(56) References Cited

U.S. PATENT DOCUMENTS

| | | | | |
|---|---|---|---|---|
| 2002/0167449 | A1 | 11/2002 | Frazita | |
| 2005/0122258 | A1* | 6/2005 | Blasing et al. | 342/179 |
| 2006/0024048 | A1* | 2/2006 | Schmidt | 396/429 |
| 2009/0273527 | A1* | 11/2009 | Behdad | 343/705 |

FOREIGN PATENT DOCUMENTS

WO 2010048174 A1 4/2010

OTHER PUBLICATIONS

Min, K-S et al., "Single-layer dipole array for linear-to-circular polarisation conversion of slotted waveguide array," IEE Proceedings: Microwaves, Antennas and Propagation, Jun. 13, 1996, pp. 211-216, vol. 43, No. 3, XP006006567, IEE, Stevenage, Herts, GB.
Son, K-S. et al., "Waveguide Slot Array In-Motion Antenna for Receiving both RHCP and LHCP using Single Layer Polarizer," Proceedings of Asia-Pacific Microwave Conference, 2006, pp. 331-334, XP031201493, Asia-Pacific, IEEE, PI.

* cited by examiner

*Primary Examiner* — Dameon E Levi
*Assistant Examiner* — Andrea Lingren Baltzell
(74) *Attorney, Agent, or Firm* — Baker and Hostetler LLP

(57) ABSTRACT

An antenna with polarization switching comprising a plurality of waveguides fed with radiofrequency signals and perforated with apertures disposed so as to illuminate radiating elements placed on mobile support means in a plane that is distant from the said apertures, it being possible for the said support means to be configured according to at least two distinct configurations. The radiating elements illuminated according to one and the same configuration are adjacent, the support means being adapted for orienting the radiating elements illuminated in a first configuration according to a different direction from the radiating elements illuminated in a second configuration. The antenna applies notably to the switching of antennas onboard objects moving on the ground required to undertake high-speed communications with a satellite, in particular a geostationary satellite.

12 Claims, 11 Drawing Sheets

MOBILE DIRECTIONAL ANTENNA WITH POLARIZATION SWITCHING

CROSS-REFERENCE TO RELATED APPLICATION

This application claims priority to foreign French patent application No. FR 1103536, filed on Nov. 21, 2011, the disclosure of which is incorporated by reference in its entirety.

FIELD OF THE INVENTION

The present invention relates to a mobile directional plane antenna with polarization switching. It applies notably to the switching of antennas onboard objects moving on the ground required to undertake high-speed communications with a satellite, in particular a geostationary satellite.

BACKGROUND

In order to provide for communications between a fixed point, for example a geostationary satellite, and a moving point, for example a vehicle on the ground, an antenna making it possible to hunt down the fixed point is disposed at the level of the moving object. The constraints to be adhered to by this antenna are severe. Notably, it must be configured so as not to emit in other directions signals with a power density greater than a regulated level, so as not to disturb the service provided for by adjacent satellites. A relatively high precision in the tracking of the satellite must therefore be guaranteed with this type of antenna. By way of example, for coverage of the European continent, the reflector of an antenna on the ground (or on an airborne carrier) must be able to be oriented in relation to an interval of angles lying between about 10° in elevation for Spain and 60° for northern Europe, the reflector being 360° orientable in relation to the azimuth angle. The reflector, with a diameter of about 60 to 70 cm, must thus benefit from a considerable freedom of movements and from a reliable and precise control system, thus leading to bulky and expensive antennas. Moreover, when the polarization of the signals is linear—if for example the satellite comprises an antenna with a single source of signals—, the ground antenna must be constantly aligned with the direction of polarization.

In order to lessen the constraints to be satisfied by ground antennas and thus simplify their production, circular polarization may be employed in place of the aforementioned linear polarization, for example in the Ka band. By way of illustration, the frequency band lying between 19.7 GHz and 20.2 GHz can serve in reception at the satellite level, while the band lying between 29.5 GHz and 30 GHz may be used in emission, coverage being provided for by a set of adjacent spots in right or left circular circulation.

Multibeam satellites cover a territory with a plurality of spots configured in such a way that the signals emitted on two neighbouring spots do not interfere. In addition, the coverage of a satellite comprises spots having various transmission frequencies and/or various polarizations, two neighbouring spots being configured so as not to have, at one and the same time, the same polarization and the same transmission frequency. The frequency characteristics and polarization characteristics of the signals emitted on a spot are generally designated by the expression "spot colour", two neighbouring spots therefore having distinct colours. By way of illustration, with two different polarizations and two different transmission frequencies, four colours of spots may be created.

Antennas onboard mobile craft required to provide for communication with a satellite sometimes cross a boundary between two spots. This is the case, for example, with antennas intended to provide an Internet connection from an aircraft or a train. When the antenna leaves the zone covered by a first spot configured with a first polarization (for example right circular) and enters the zone covered by a second spot configured with a second polarization (left circular), the antenna must switch rapidly so as to modify its emission and/or reception polarization. Furthermore, the radiating elements of a beamforming antenna must be sufficiently close together to avoid the formation of lateral radiation lobes, liable to perturb adjacent communication systems.

A publication by Kwang-Seop Son et al., published in 2006 in "Proceedings of Asia-Pacific Microwave conference" under the title "Waveguide Slot Array In-Motion Antenna for Receiving both RHCP and LHCP using Single Layer Polarizer", discloses an antenna structure comprising sources of signals exciting polarizers aligned on a film. The polarizers are arranged alternately in opposite directions and the sources are separated from the film of polarizers by a radiofrequency-insulating layer and provided with a series of cavities placed facing the polarizers in such a way that at a given instant, one polarizer out of two is illuminated by a source. The film may be actuated in translation so that the cavities are placed facing the polarizers which were not previously illuminated. These polarizers being oriented in a different direction from the first polarizers, the polarization of the signals emitted by the antenna is reversed. This antenna therefore makes it possible to carry out a switching between two different polarizations. However, it comprises drawbacks. Indeed, its structure imposes a relatively large distance between the radiating elements, thereby giving rise to overly sizable lateral lobes in the radiation pattern.

SUMMARY OF THE INVENTION

An aim of the invention is to propose a directional and compact electronic beamforming antenna able to switch its polarization. For this purpose, the subject of the invention is an antenna with polarization switching comprising a plurality of waveguides fed with radiofrequency signals and perforated with apertures disposed so as to illuminate radiating elements placed on mobile support means in a plane that is distant from the said apertures, it being possible for the said support means to be configured according to at least two distinct configurations, wherein the radiating elements illuminated according to one and the same configuration are adjacent, the support means being adapted for orienting the radiating elements illuminated in a first configuration according to a different direction from the radiating elements illuminated in a second configuration. The radiating elements may have a linear shape. The antenna according to the invention does not impose any distance between the radiating slots, thereby making it possible to adhere to the criterion for rejecting the array lobes outside of a scan zone, even for a scan of +/−40°.

According to one embodiment of the antenna with polarization switching according to the invention, the radiating elements illuminated according to the first configuration and the radiating elements illuminated according to the second configuration are the same, the support means being adapted for modifying their orientation with respect to the apertures. Thus, only one radiating element is needed per aperture and each of the radiating elements is illuminated through the same aperture regardless of the configuration.

According to one embodiment of the antenna with polarization switching according to the invention, the waveguides are rectangular cross-section guides, the apertures being distributed, for each of the waveguides, on a face of the said waveguide alternately on either side of its longitudinal mid-axis. Thanks to the use of hollow waveguides, the antenna has lower losses; ohmic efficiency is the highest possible.

According to one embodiment of the antenna with polarization switching according to the invention, the apertures are slots. The antenna is more robust than other flat antennas, such as microstrip patches.

According to one embodiment of the antenna with polarization switching according to the invention, the slots are parallel to the longitudinal axis of the waveguides. This embodiment allows space saving.

According to one embodiment of the antenna with polarization switching according to the invention, the radiating elements are dipoles. The dipoles can for example be formed of a rectilinear metal component.

According to one embodiment of the antenna with polarization switching according to the invention, the radiating elements are placed above the apertures at a height comprised between a fifth and a quarter of the wavelength of the radiofrequency signals travelling in the waveguides.

According to one embodiment of the antenna with polarization switching according to the invention, the support means of the radiating elements are constructed of a material which is transparent to radiofrequency waves.

According to one embodiment of the antenna with polarization switching according to the invention, the support means of the radiating elements comprise several parallel strips maintained above the apertures, it being possible for the said strips to be arranged according to two configurations, the said strips being able to invert so as to place a first face of the strips facing the apertures in the first configuration, and the opposite face of the said strips facing the apertures in the second configuration.

According to one embodiment of the antenna with polarization switching according to the invention, the radiating elements form a nonzero and non-orthogonal angle with the longitudinal axis of the strips, the strips being able to rotate about the said longitudinal axis in order to invert.

According to one embodiment of the antenna with polarization switching according to the invention, the support means of the radiating elements comprise pivoting elements aligned according to several rows, the said support means comprising, for each of the said rows, a rod adjoining the pivoting elements of the said row, the said rod and the said pivoting elements being configured in such a way that a translational motion of the said rod drives the said pivoting elements in rotation. The rod can for example be a rack, the pivoting elements being cylinders comprising striations on their edge so as to be able to be driven by the said rack. Thus, only one radiating element per aperture is needed and each of the radiating elements is illuminated through the same aperture regardless of the configuration.

According to one embodiment of the antenna with polarization switching according to the invention, the support means of the radiating elements comprise rollers and a flexible band arranged so as to be able to wind up around the said rollers, the flexible band comprising a first part on which are fixed adjacent radiating elements oriented in a first direction, and a second part on which are fixed adjacent radiating elements oriented in a different direction from the said first direction.

BRIEF DESCRIPTION OF THE DRAWINGS

Other characteristics will become apparent on reading the following nonlimiting detailed description given by way of example and in relation to appended drawings which represent.

DETAILED DESCRIPTION

Figure 1A:
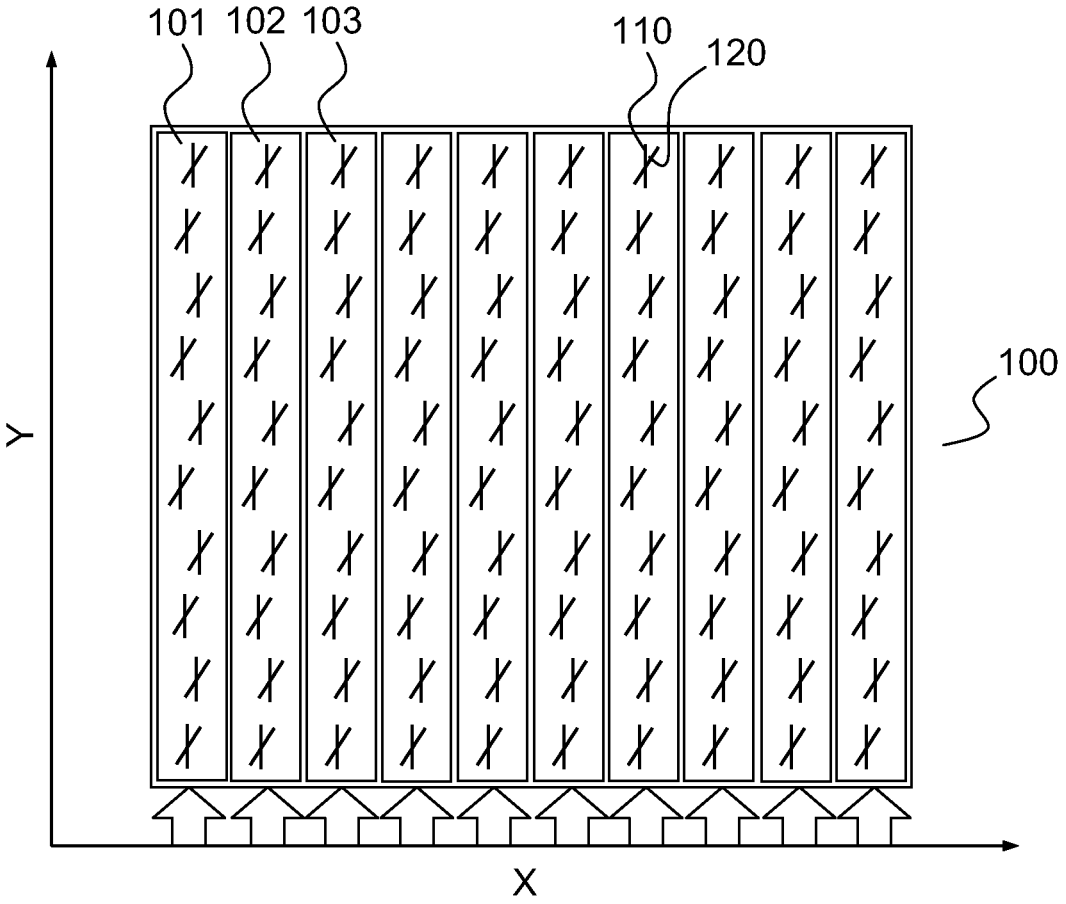
FIGS. 1*a* and 1*b*, a basic diagram illustrating the antenna according to the invention.
Figure 1B:
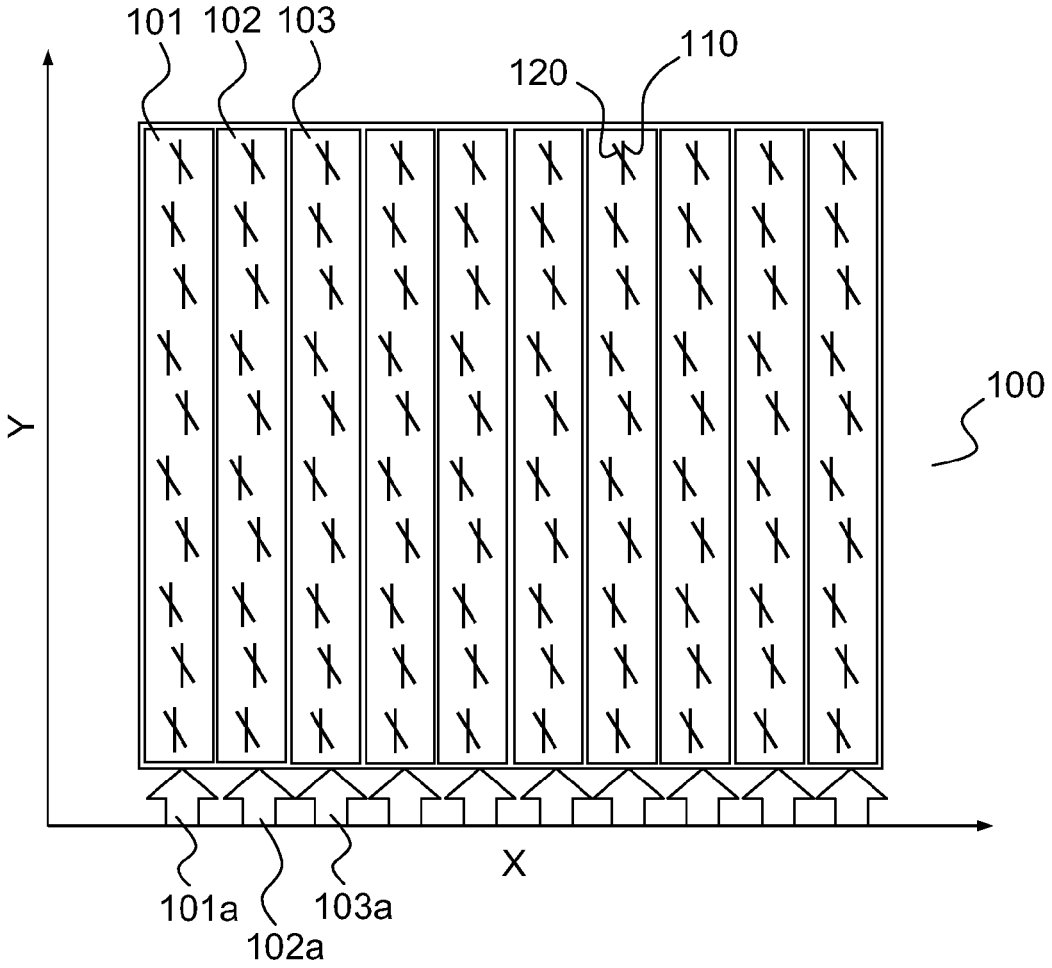

FIGS. 1*a* and 1*b* illustrate by basic diagrams the antenna according to the invention. The antenna 100 is viewed from above. Each of the waveguides 101, 102, 103 is fed with radiofrequency signals 101*a*, 102*a* 103*a* and extends parallel to the Y axis. The waveguides may be guides with rectangular cross-section. Each waveguide 101, 102, 103 is regularly drilled with apertures 110 in the form of rectangular slots preferably parallel to the waveguide, so as to reduce the dimensions of the antenna. By way of example, the antenna occupies an area of about 6 cm×6 cm.

A radiating element 120 in the form of a dipole is placed above each aperture 110, in a plane parallel to the plane in which the apertures 110 are made. The plane in which the dipoles are placed is advantageously situated at a distance equal to a value chosen between a fifth and a quarter of the wavelength of the signals transmitted in the waveguides, in order to produce such a perturbation on the field coming from the aperture so that two orthogonal field components, equal in magnitude and out of phase by 90 degrees, i.e. circularly polarized field, are obtained. The choice of the distance causes a phase difference of 90 degrees. The dipoles 120 form, viewed from above, a nonzero and non-perpendicular angle with the apertures 110 formed in the waveguide 101, 102, 103.

The antenna according to the invention can take at least two configurations. FIG. 1*a* illustrates a first configuration of the antenna in which a first angle is formed between each of the apertures 110 and the dipoles 120, this angle being equal, for example to 45°. That first angle can theoretically take any value between 0° and 90° strictly excluding 0° and 90°. The angle chosen may result from an analysis taking into account lengths and widths of both, slot and dipole, along with the selected distance between them and the permittivity of the media around. FIG. 1*b* illustrates a second configuration of the antenna in which the angle formed between the apertures 110 and the dipoles 120 is equal to the opposite of the first angle. Stated otherwise, the dipoles 120 placed above the apertures 110 in the second configuration of the antenna 100 (FIG. 1*b*) form, with the dipoles 120 placed above the apertures 110 in the first configuration (FIG. 1*a*), an angle equal to twice the angle formed between the dipoles 120 of the first configuration and the apertures 110.

Figure 2A:
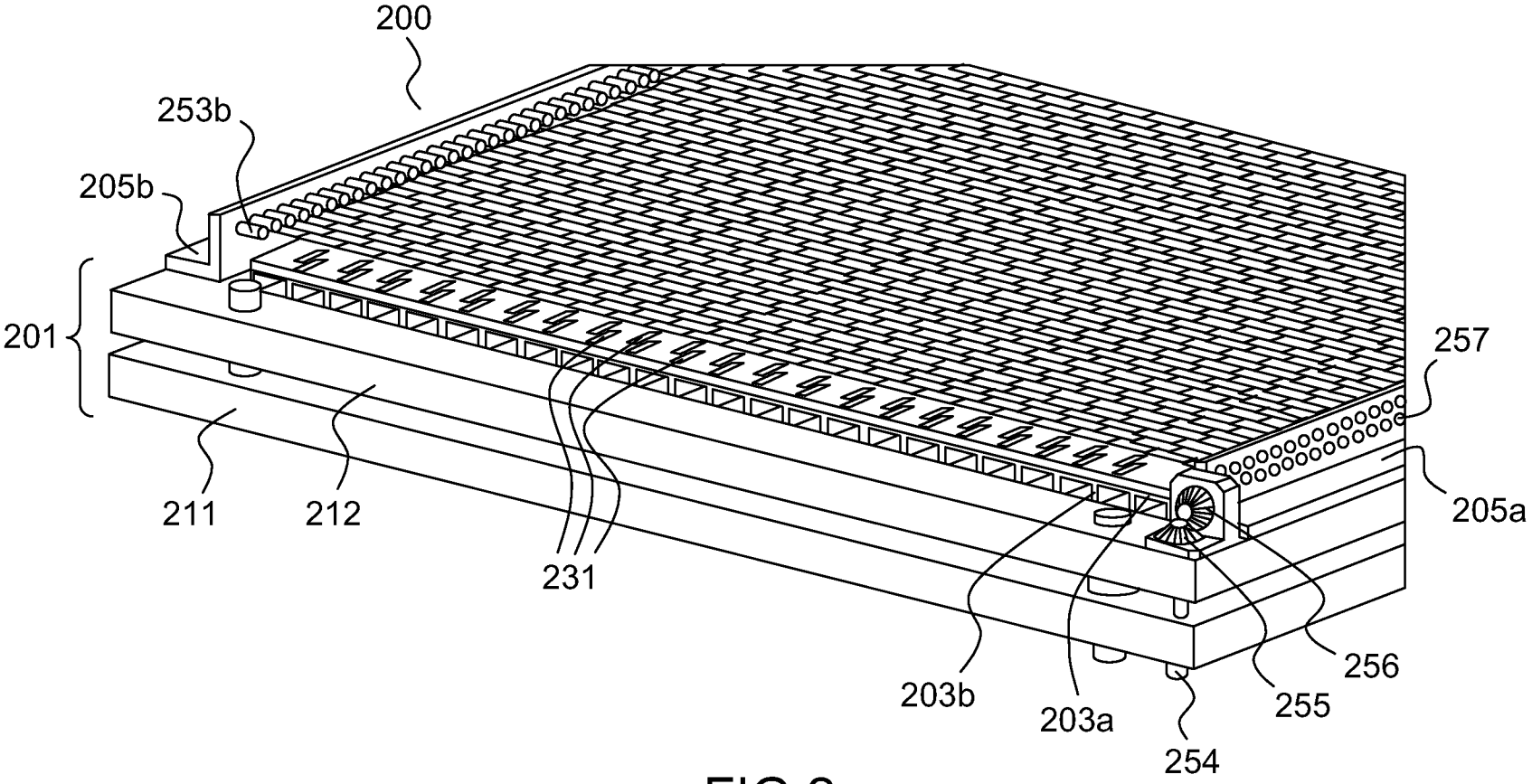
FIG. 2*a*, a first embodiment of the antenna according to the invention, viewed in perspective.
Figure 2B:
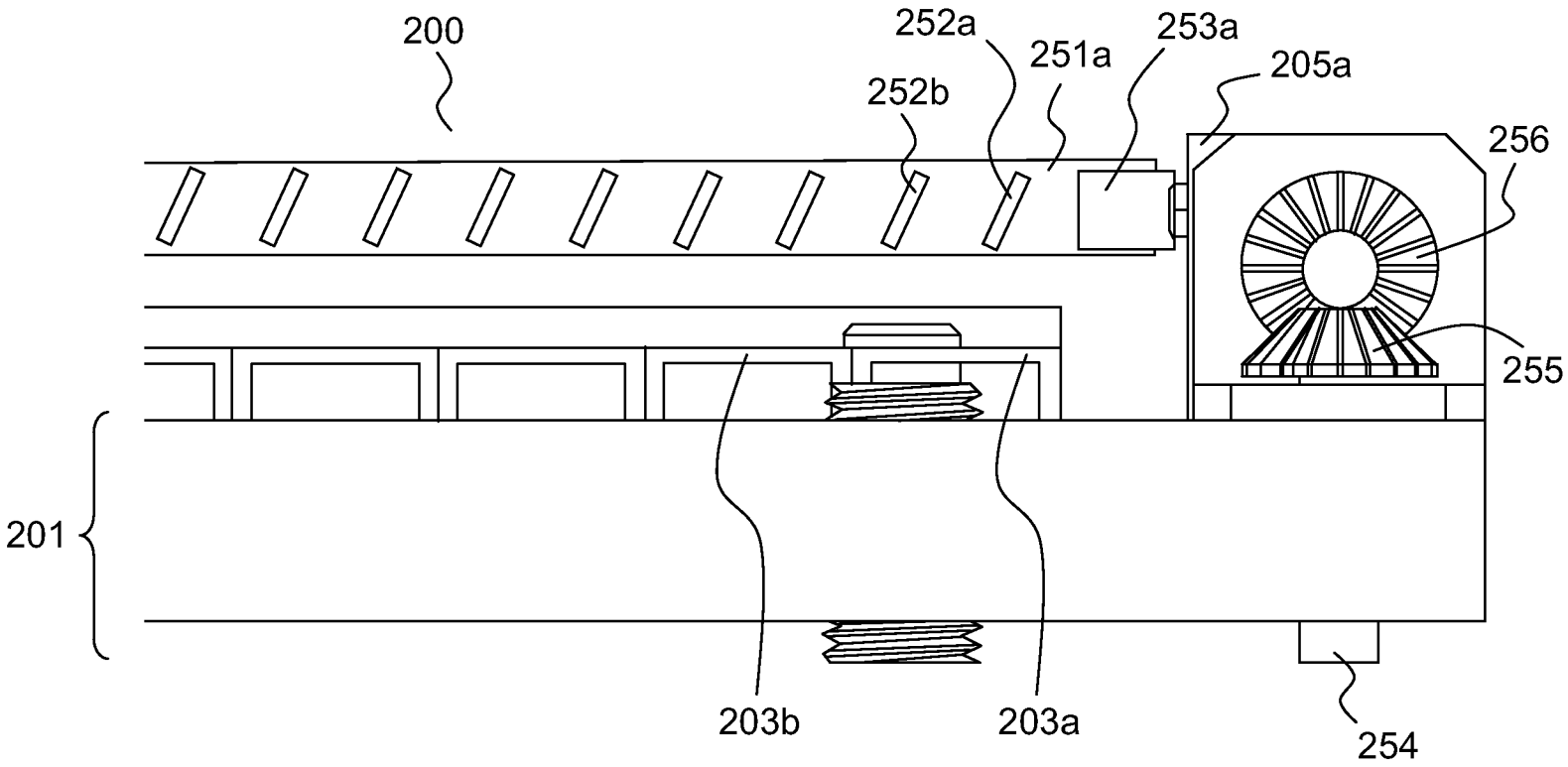
FIG. 2*b*, the first embodiment of the antenna according to the invention, viewed from the side.
Figure 2C:
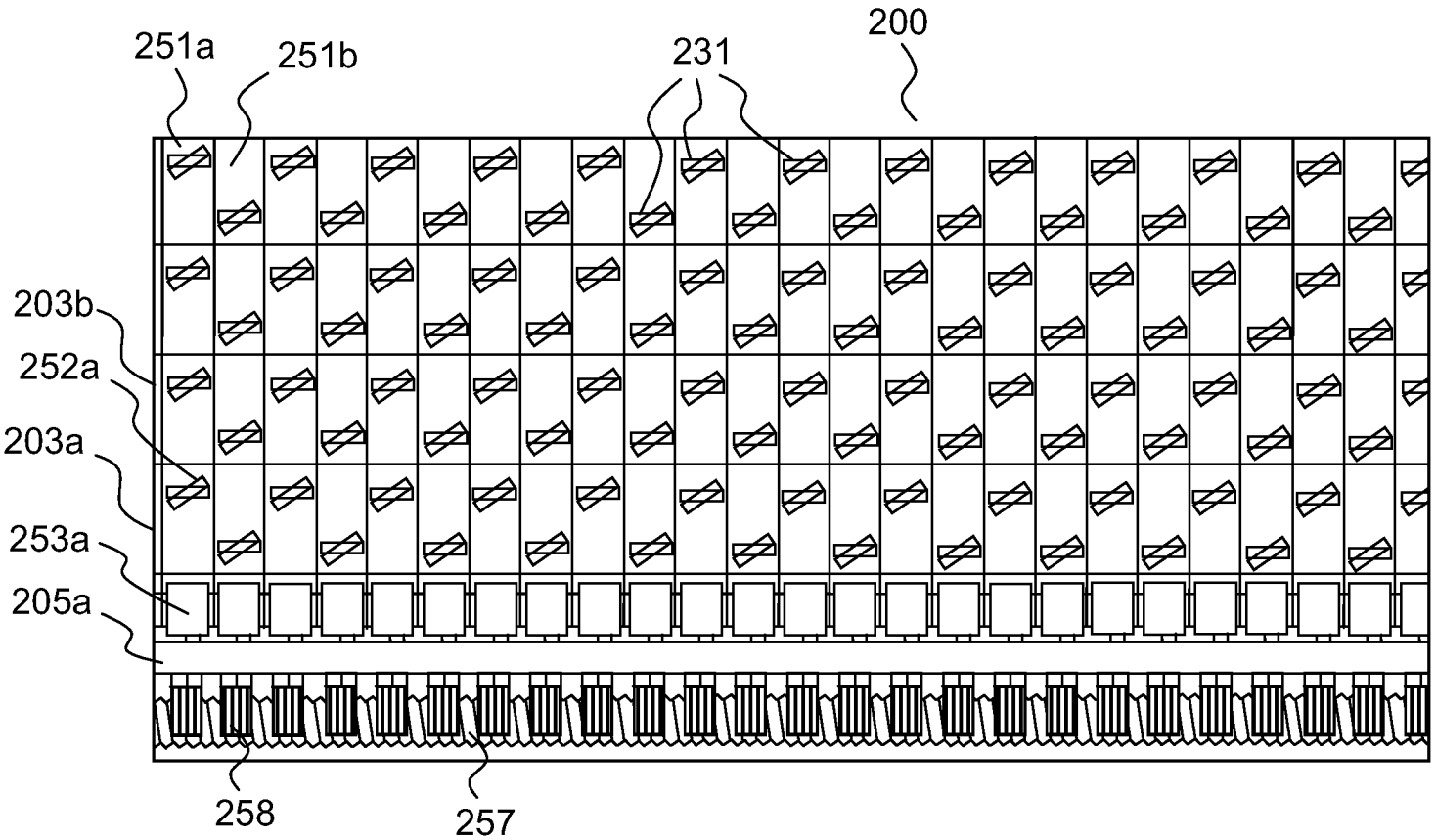
FIG. 2*c*, the first embodiment of the antenna according to the invention, viewed from above.

FIGS. 2*a*, 2*b* and 2*c* present a first embodiment of the antenna according to the invention, viewed respectively in perspective, from the side and from above. The antenna 200 comprises support means 201 on which are disposed waveguides 203*a*, 203*b* and two brackets 205*a*, 205*b* supporting a plurality of rigid strips 251*a*, 251*b* above the waveguides 203*a*, 203*b*.

The waveguides 203*a*, 203*b* extend parallel to one another. They may be fed with signals from an end. In the example, these waveguides 203*a*, 203*b* are of rectangular cross-section. They are drilled in their upper part, so as to form slots 231. Advantageously, the slots are oriented parallel to one another and in the longitudinal direction of the waveguides 203*a*, 203*b*. In the example, the slots are placed identically from one waveguide 203*a* to the other 203*b*. Moreover, in each waveguide 203*a*, 203*b*, the slots 231 are preferably placed alternately on either side of the longitudinal mid-axis 233 of the waveguide in order to make the slots radiate in phase, so as to form a regular grid of slots 231 over the whole area of the antenna 200.

The brackets 205*a*, 205*b* are placed facing one another, on two opposite edges of the support means 201, parallel to the waveguides 203*a*, 203*b*. Holding elements 253*a*, 253*b* for strips are mounted in pairs on each of the brackets, a first holding element being mounted on the first bracket 205*a*, a second holding element being mounted on the second bracket 205*b*, the two elements facing one another so as to hold the strips 251*a*, 251*b* at a predetermined distance above the waveguides 203*a*, 203*b*, the strips extending in a direction perpendicular to the waveguides. The holding elements 253*a*, 253*b* are mounted so that they are able to rotate about an axis joining two holding elements 253*a*, 253*b* of one and the same pair, that is to say by two holding elements supporting one and the same strip 251*a*. The holding elements 253*a*, 253*b* of one and the same pair can thus rotate in a coordinated manner so as to drive the strip that they hold in rotation about the longitudinal axis of the strip 251*a*. In the example, the first holding element 253*a* of a pair is driven by controlled rotation means, the second holding element 253*b* is simply in free rotation about an axis and driven under the effect of a rotation of the strip 251*a*. The controlled rotation means can comprise a set of two bevel gears 255, 256 making it possible to transform a rotational motion about an axis orthogonal to the plane of the antenna 200 into a rotational motion about an axis parallel to the brackets 205*a*. The first gear 255 is for example secured to a rod 254 driven in rotation by a motor (not represented in the figure). The second gear 256 drives an endless screw 257 adjoining the holding elements 253*a*, 253*b*, thus making it possible to transmit the rotational motion to them, these holding elements comprising a striated projecting part 258 protruding from the rear of the bracket 205*b*.

Dipoles 252*a*, 252*b* are disposed on the strips 251*a*, 251*b* so as to be positioned above the slots 231 formed in the waveguides 203*a*, 203*b*. The strips 251*a*, 251*b* are transparent to radiofrequency signals so as not to disturb the radiating effect of the dipoles 252*a*, 252*b*.

The support means 201 comprise a lower part 211 and an upper part 212, which is mounted so as to move along an axis orthogonal to the plane formed by the support means 201. In the example, the lower part 211 and the upper part 212 are material plates which are able to move away from or towards one another by virtue of sliding means, comprising for example rods 254, rams, endless screws, or any other means making it possible to vary the distance between the two parts 211, 212. The upper part 212 maintains a constant distance with the brackets 205*a*, 205*b* and the strips 251*a*, 251*b*, the brackets 205*a*, 205*b* being fixed to this upper part 212. The lower part 211 maintains a constant distance with the waveguides 203*a*, 203*b*, the waveguides 203*a*, 203*b* being fixed to uprights 214 secured to this lower part 211. Thus when the two parts 211, 212 move away from one another, the brackets 205*a*, 205*b* and the strips 251*a*, 251*b* move away from the waveguides 203*a*, 203*b*.

During normal operation of the antenna 200, the lower part 211 and the upper part 212 are adjoining. The distance between the slots 231 and the strips 251*a*, 251*b* is chosen so that the radiofrequency signals travelling through the slots 231 excite the dipoles and thus make it possible to create an array of radiating elements according to a given polarization.

When a rotation of the strips 251*a*, 251*b* has to be performed, the upper part 212 is moved away from the lower part 211, so as not to damage the strips 251*a*, 251*b* and/or the holding elements 253*a*, 253*b* during the rotation, by avoiding a collision of these elements with the waveguides 203*a*, 203*b*. In addition, when the polarization of the antenna has to switch, the upper part 212 detaches from the lower part 211 so as to let the rotation of the strips 251*a*, 251*b* proceed without damage, before the two parts 211, 212 are moved back together again once the rotation has been performed—this moving back together can be effected progressively once the rotation by a quarter of a turn has been performed.

Figure 2D:
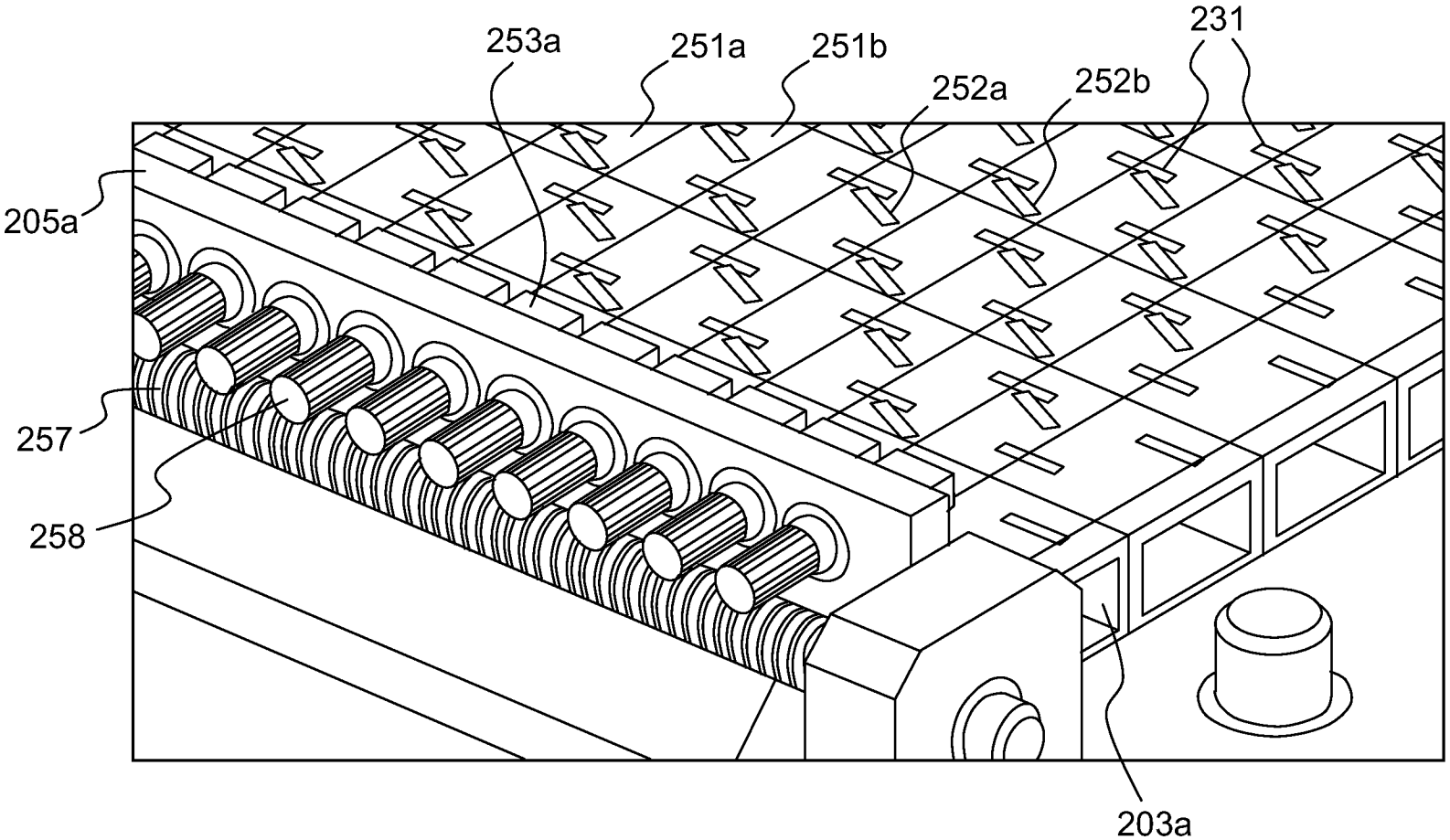
FIGS. 2*d*, 2*e*, and 2*f*, illustrations of the switching phase of the first embodiment of the antenna according to the invention, viewed in perspective.
Figure 2E:
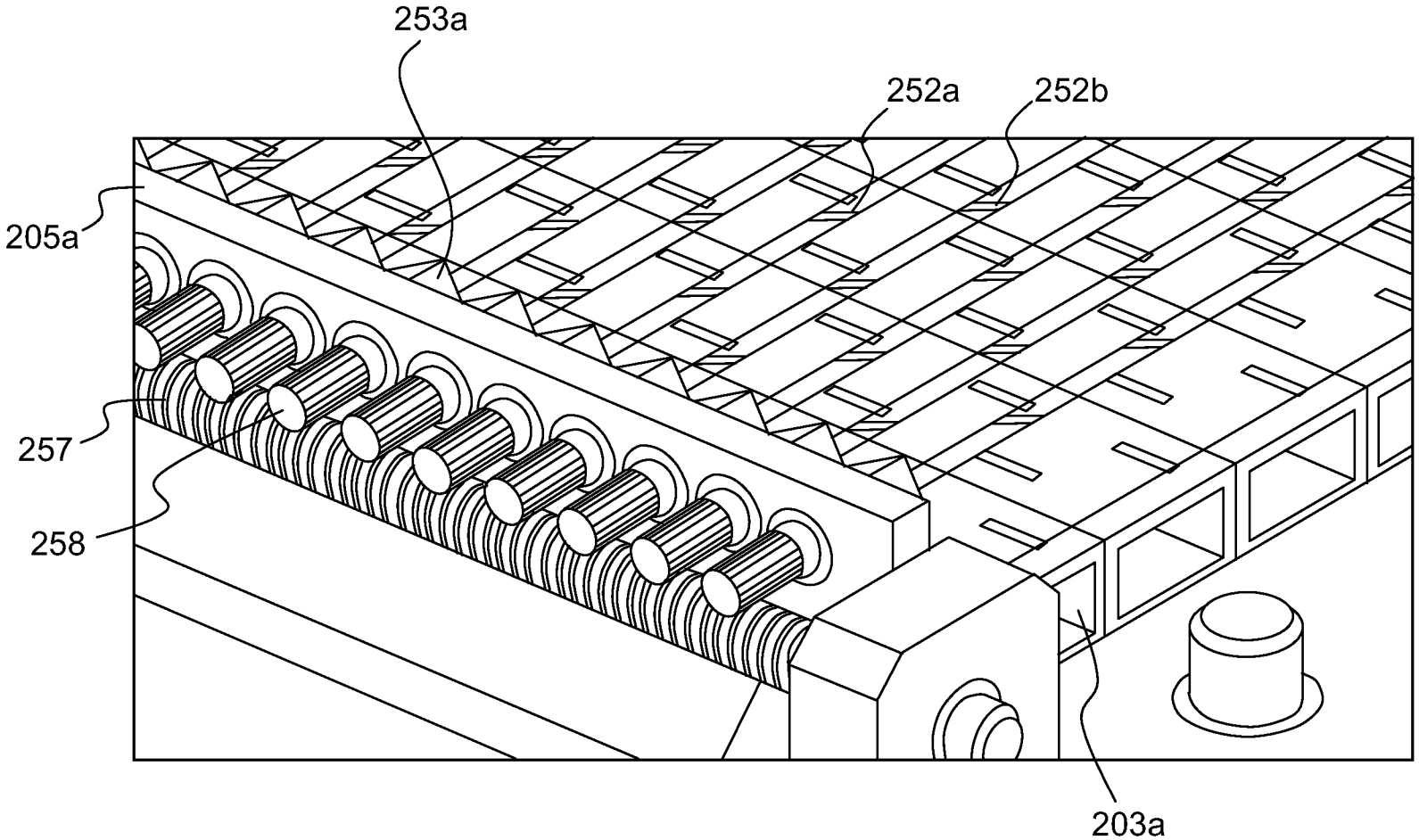
Figure 2F:
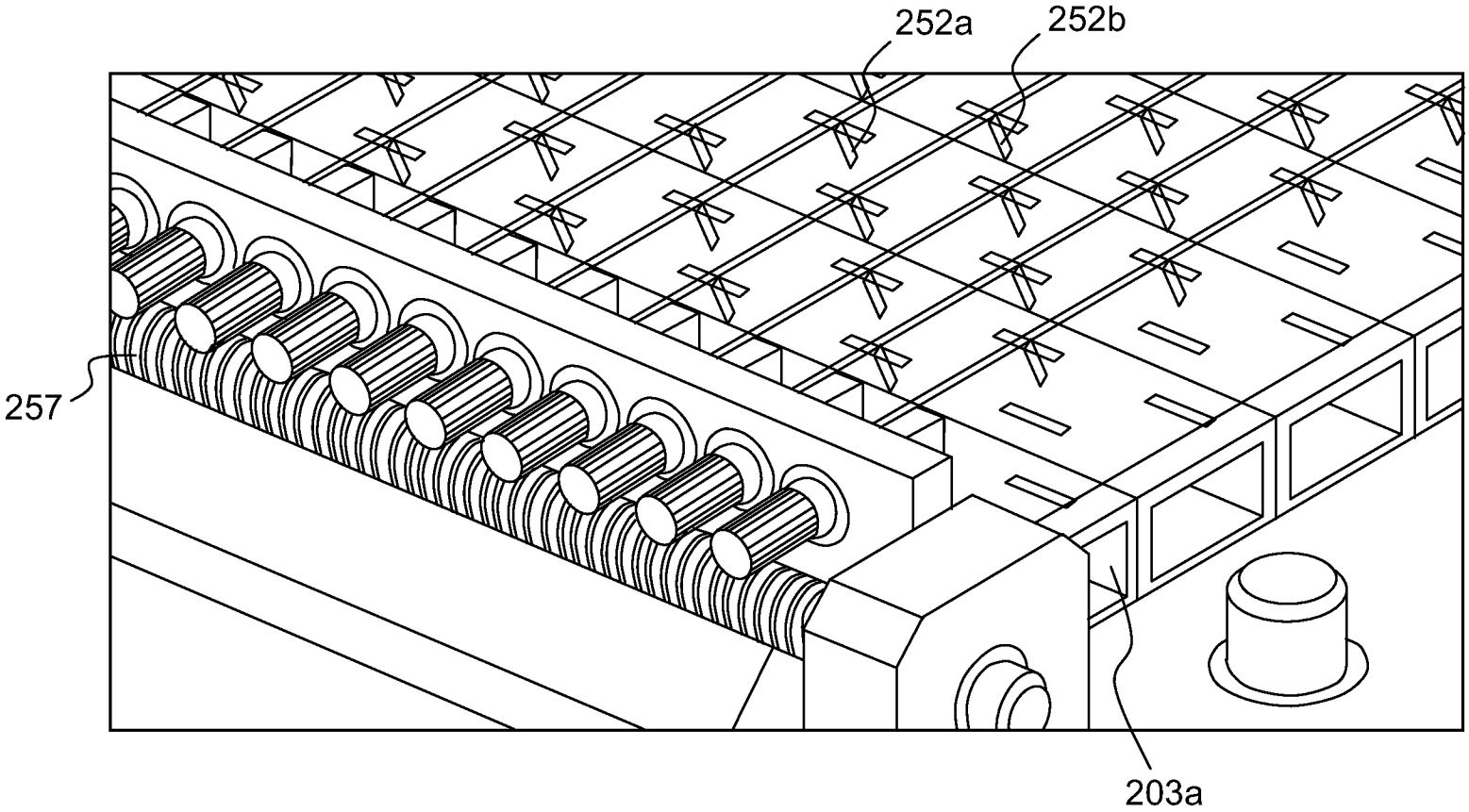

FIGS. 2*d*, 2*e*, and 2*f* illustrate the switching phase of the first embodiment of the antenna according to the invention, viewed in perspective. According to a first configuration of the antenna 200, illustrated in FIG. 2*d*, the strips 251*a*, 251*b* are held in the horizontal position, all the dipoles 252*a*, 252*b* being oriented in a given direction.

When a switching of the antenna 200 is performed, the upper part 212 of the support means is displaced so as to move it away from the lower part 211. Once the strips 251*a*, 251*b* are sufficiently distant from the waveguides 203*a*, 203*b*, the rod 254 is set into rotation. This rod 254 causes the rotation of the first bevel gear 255, which transmits the rotational motion to the second bevel gear 256, which provides for the rotation of the endless screw 257 so as to rotate the holding elements 253*a* fixed to the bracket 205*a*, and consequently the strips 251*a*, and the holding elements 253*b* fixed to the opposite bracket 205*b*. FIG. 2*e* illustrates the first embodiment of the antenna when the rotation of the strips 251*a*, 251*b* is in progress. The strips 251*a*, 251*b* are in the process of inverting. The rotation is activated until the upper face of the strips 251*a*, 251*b* replaces the lower face. Advantageously, the dipoles 252*a*, 252*b* are centred on the axis of rotation of the strip on which they are fixed, in such a way that their position in the first configuration is symmetric with their position in the second configuration. Once the rotation has been accomplished, the antenna 200 is situated in the second configuration, illustrated by FIG. 2*f*. The orientation of the dipoles 252*a*, 252*b* is then modified since their position undergoes a transformation with respect to the axis of symmetry formed by the axis of rotation of the strip 251*a*, 251*b*. On account of the change of position of the dipoles with respect to the slots above which they are situated, the polarization of the signals transmitted by the antenna is reversed. Thus, in the case of circularly polarized signals, the passage from one configuration to the other of the antenna makes it possible to pass from a left circular circulation to a right circular circulation.

In contradistinction to certain antennas known in the prior art, no element is inserted between the dipoles, whatever the configuration of the antenna, thereby making it possible to reduce the spacing between the dipoles. The arrangement of the slots and dipoles thus makes it possible to obtain an antenna comprising a high density of radiating elements, while having the capability of switching its polarization.

Figure 3A:
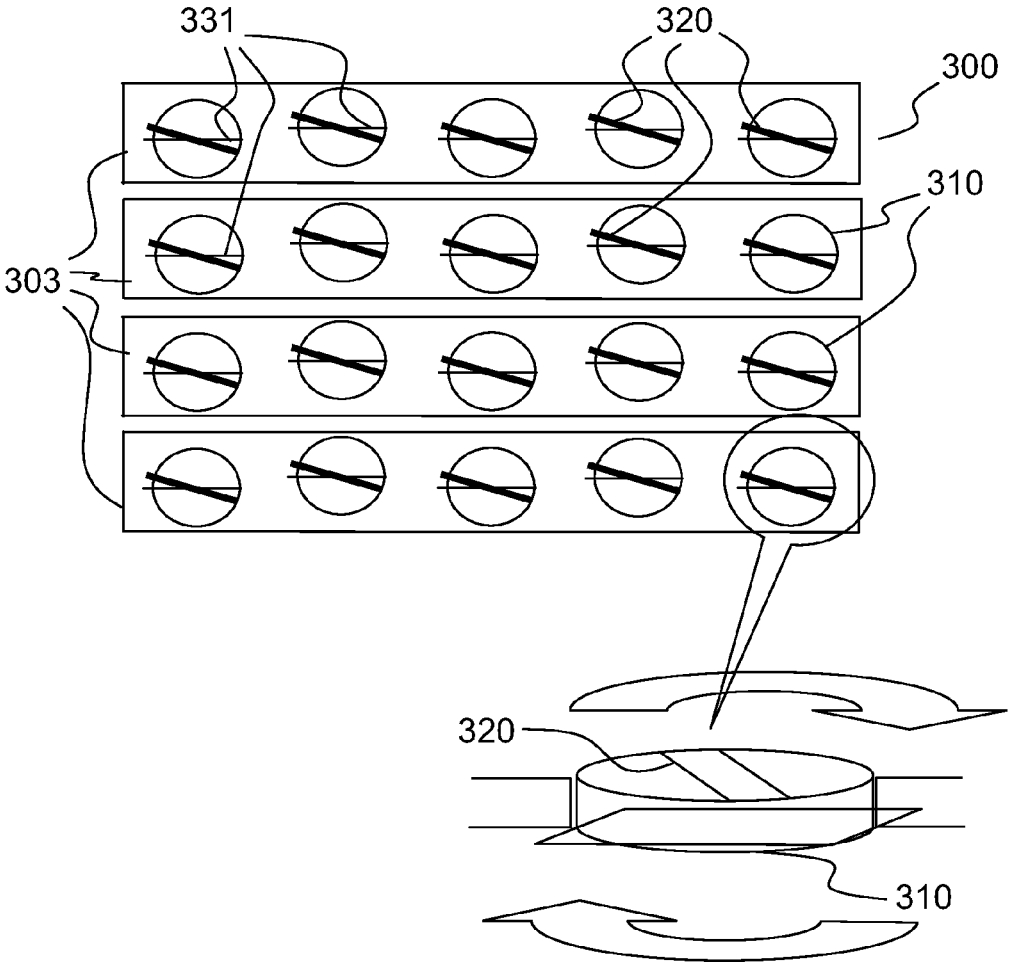
FIGS. 3*a*, 3*b* and 3*c*, a second embodiment of the antenna according to the invention.
Figure 3B:
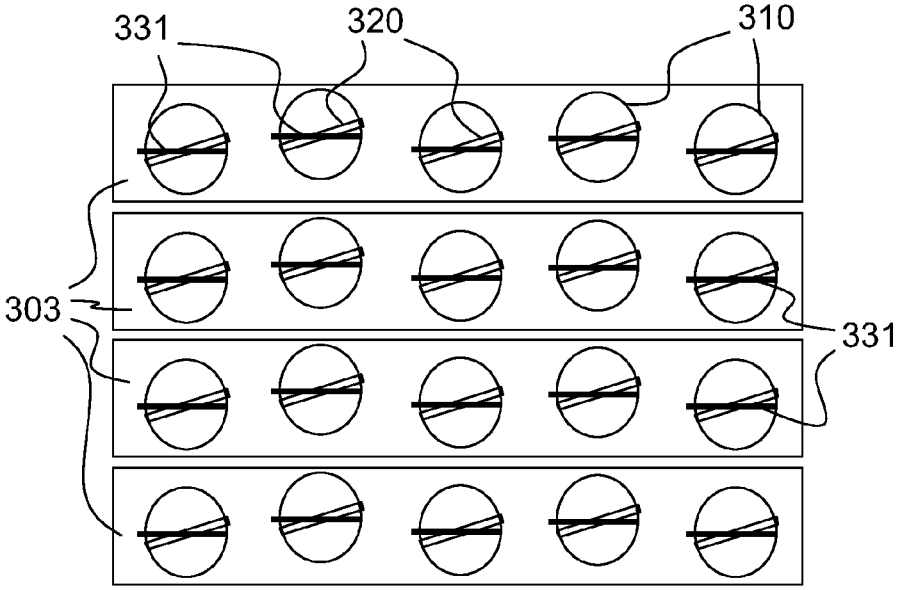
Figure 3C:
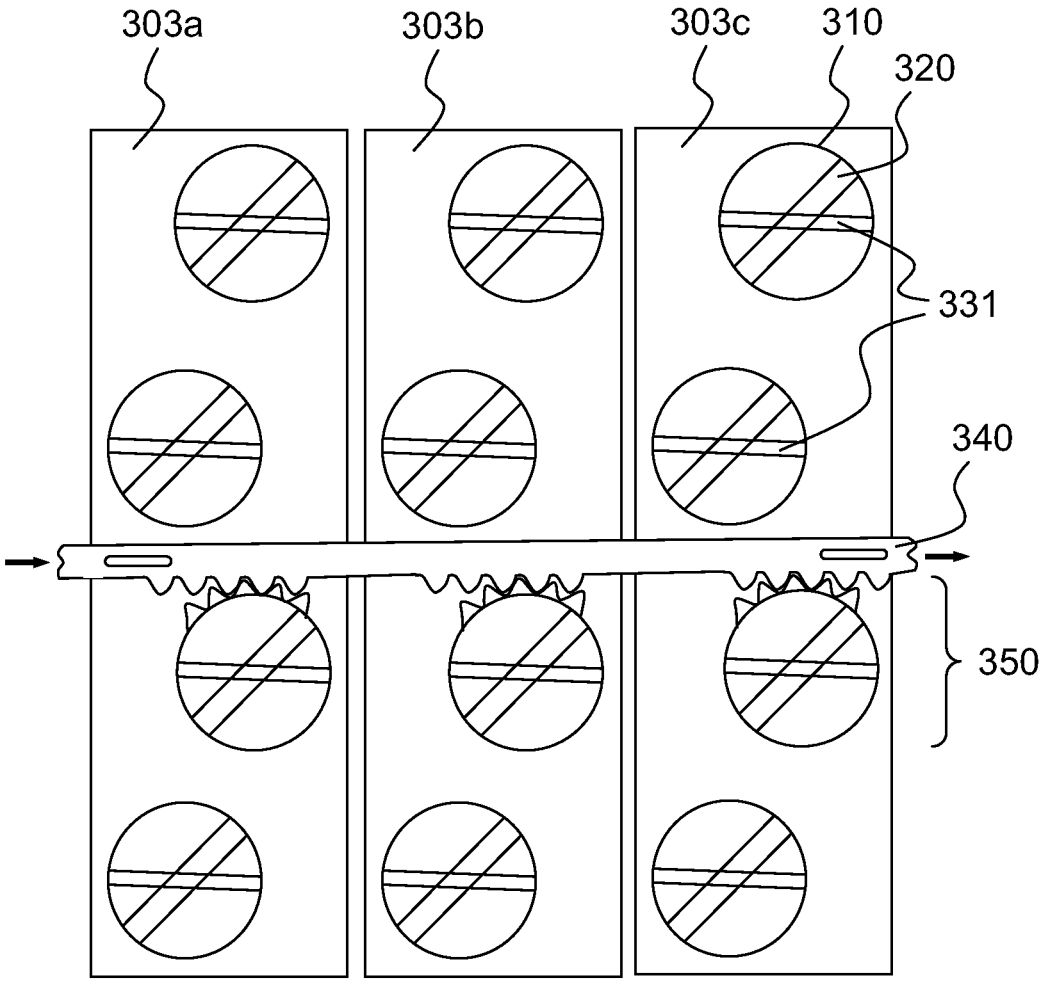

FIGS. 3*a*, 3*b* and 3*c* present a second embodiment of the antenna according to the invention. The antenna 300 comprises mutually parallel waveguides 303. Slots 331 are formed in the upper part of the waveguides, similarly to those of the first embodiment presented in FIG. 2*a*. A pivoting support 310, for example such as illustrated by the detail of FIG. 3*a*, able to rotate about an axis orthogonal to the plane of the antenna 300 is disposed on each slot 331. A dipole 320 is fixed to each of the pivoting supports 310, so as to be illuminated by the radiofrequency signals travelling through the slots 331. The pivoting support 310 may be cylindrical and formed of a material which is transparent to radiofrequency signals.

The antenna 300 takes at least two configurations, a first configuration, illustrated in FIG. 3*a*, in which the dipoles are oriented in a first direction, and a second configuration, illustrated in FIG. 3*b*, in which the dipoles are oriented in a second direction. The two configurations of the antenna 300 correspond to different polarizations.

The orientation of dipoles disposed in a row is controlled by a rack 340 placed along this row. For example, a row 350 comprising pivoting supports 310 placed above different waveguides 303*a*, 303*b*, 303*c* is controlled by a rack adjoining the pivoting supports and comprising notches at least at the level of the pivoting supports 310. The pivoting supports 310, in the example cylindrical, comprise striations on their wall, so that when the rack 340 is displaced according to a translational motion along the row 350, it drives the pivoting supports 310 in rotation, and consequently the dipoles 320 which are fixed thereto. A different rack may be assigned to each row of dipoles, in such a way that drive means drive the translation of all the said racks, so as to rotate all the pivoting supports and thus modify the polarization configuration of the antenna. Advantageously, the antenna 300 is configured so that the translations of racks 340 correspond to a rotation of half a turn of the pivoting supports 310.

According to another embodiment of the antenna, the rack 340 is replaced with a rod pressed against the pivoting supports 310, the said rod having capabilities for adhering to the pivoting supports 310, the said rod and the said pivoting supports being for example formed of a rubbery material.

Figure 4A:
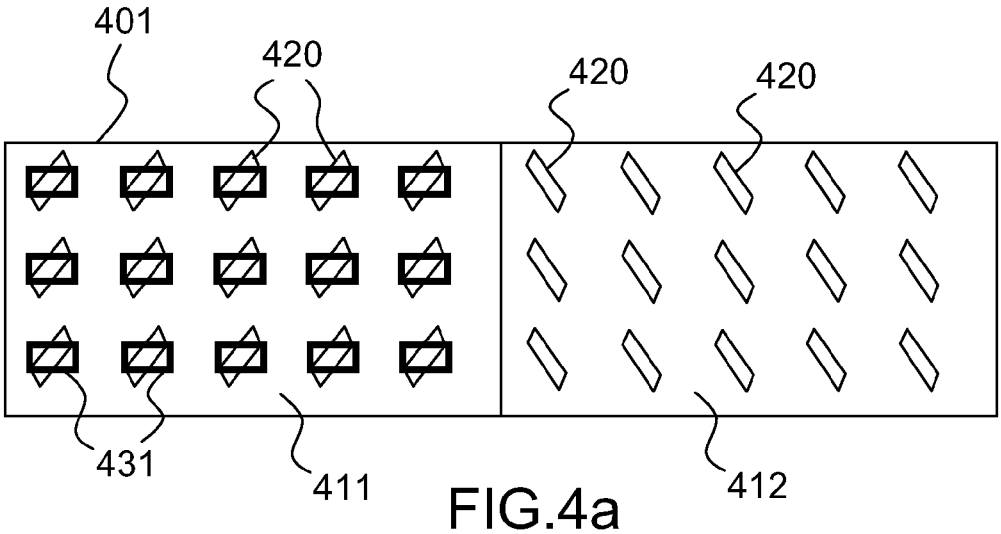
FIGS. 4*a*, 4*b* and 4*c*, a third embodiment of the antenna according to the invention.
Figure 4B:
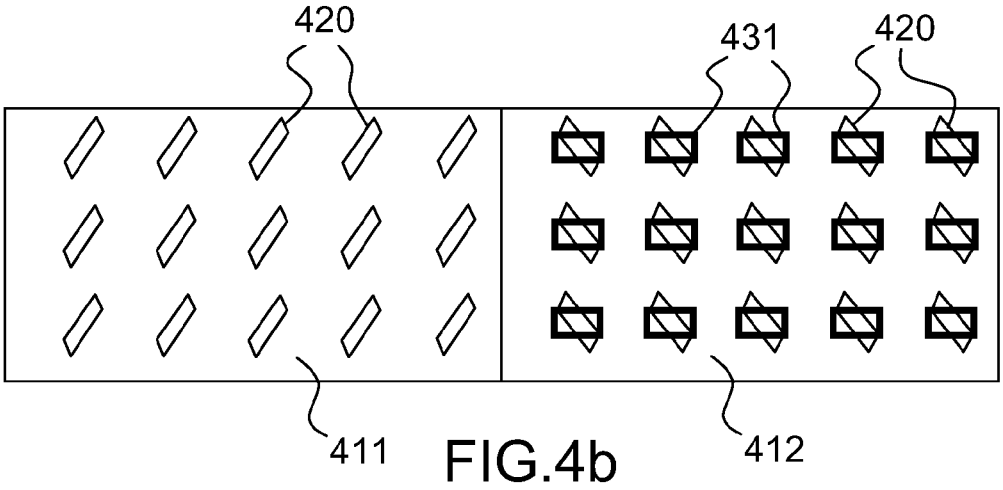
Figure 4C:
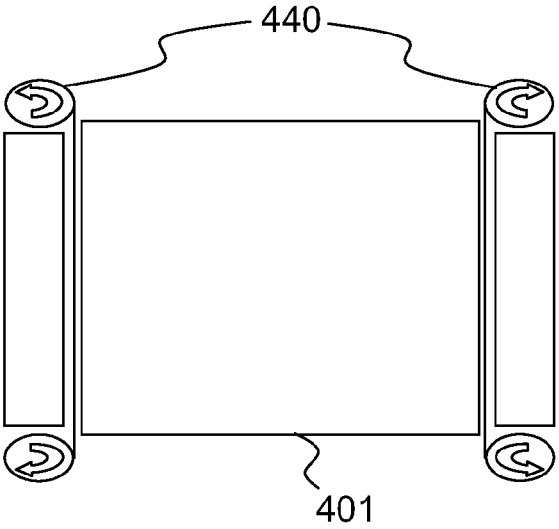

FIGS. 4*a*, 4*b* and 4*c* present a third embodiment of the antenna according to the invention. The antenna 400 comprises a flexible band 401 comprising two separate parts 411, 412. The first part 411 and the second part comprise dipoles 420 in equal numbers in the two parts 411, 412. The dipoles 420 of the second part 412 are placed in such a way that their respective centres of gravity could be superimposed on the centres of gravity of the dipoles 420 of the first part 411. The orientations of the dipoles are identical within one and the same part 411, 412, but are different from one part to the other.

The antenna 400 also comprises a set of waveguides comprising apertures in the form of slots 431, as well as drive means for the flexible band 401 so as to place this flexible band 401 above the slots 431 while matching up the positions of the dipoles 420 and the positions of the slots 431. The drive means can comprise two rollers 440 (FIG. 4*c* presents the antenna viewed from the top) placed facing one another so as to wind up or unwind the flexible band 401 above the waveguides. The two rollers 440 may be placed on edges of the antenna 400, similarly to the disposition of the brackets (cf. FIG. 2*a*) in the first embodiment described above.

According to a first configuration of the antenna 400, the rollers 440 are activated so as to place the first part 411 above the slots 431, in order to generate a first antenna polarization. According to a second configuration of the antenna 400, the rollers 440 are activated so as to place the second part 412 above the slots 431, in order to generate a second antenna polarization.

The antenna switching can thus be triggered by the motorized activation of the rollers in one direction or in the other, so as to modify the orientation of the dipoles illuminated by the radiofrequency signals travelling through the slots of the waveguides.

An advantage of the antenna according to the invention is that it does not impose any distance between the slots, thereby making it possible to densify the array of radiating elements and thus to obtain a directional radiation pattern.

The invention claimed is:

1. An antenna with polarization switching comprising:

a plurality of waveguides fed with radiofrequency signals and perforated with apertures, the apertures being disposed to illuminate radiating elements placed on support means in a plane that is distant from the apertures, the support means being configured to switch between at least a first and a second configuration, wherein in the first configuration adjacent radiating elements are illuminated and oriented along a first direction with respect to the apertures, and in the second configuration adjacent radiating elements are illuminated and oriented along a second direction, different from the first direction, with respect to the apertures.

2. The antenna with polarization switching according to claim 1, wherein the radiating elements illuminated according to the first configuration and the radiating elements illuminated according to the second configuration are the same, and wherein the support means is adapted to modify the orientation of the radiating elements with respect to the apertures.

3. The antenna with polarization switching according to claim 1, wherein the waveguides are rectangular cross-section guides, the apertures being distributed, for each of the waveguides, on a face of the waveguide alternately on either side of a longitudinal mid-axis of the waveguides.

4. The antenna with polarization switching according to claim 1, wherein the apertures are slots.

5. The antenna with polarization switching according to claim 4, wherein the slots are parallel to a longitudinal axis of the waveguides.

6. The antenna with polarization switching according to claim 1, wherein the radiating elements are dipoles.

7. The antenna with polarization switching according to claim 1, wherein the radiating elements are placed above the apertures at a height comprised between a fifth and a quarter of the wavelength of the radiofrequency signals travelling in the waveguides.

8. The antenna with polarization switching according to claim 1, wherein the support means of the radiating elements are constructed of a material which is transparent to radiofrequency waves.

9. The antenna with polarization switching according to claim 1, wherein the support means of the radiating elements comprise several parallel strips maintained above the apertures, it being possible for the strips to be arranged according to at least the first configuration and the second configuration, the strips being able to invert so as to place a first face of the strips facing the apertures in the first configuration, and the opposite face of the strips facing the apertures in the second configuration.

10. The antenna with polarization switching according to claim 9, wherein the radiating elements form a nonzero and non-orthogonal angle with a longitudinal axis of the strips, the strips being able to rotate about the longitudinal axis in order to invert.

11. The antenna with polarization switching according to claim 1, wherein the support means of the radiating elements comprise pivoting elements aligned according to several rows, the support means comprising, for each of the rows, a rod adjoining the pivoting elements of the row, the rod and the pivoting elements being configured in such a way that a translational motion of the rod drives the pivoting elements in rotation.

12. The antenna with polarization switching according to claim 1, wherein the support means of the radiating elements comprise rollers and a flexible band arranged so as to be able to wind up around the rollers, the flexible band comprising a first part on which are fixed adjacent radiating elements oriented in a first direction, and a second part on which are fixed adjacent radiating elements oriented in a different direction from the first direction.

* * * * *